US008690556B2

(12) United States Patent
Yoshida et al.

(10) Patent No.: US 8,690,556 B2
(45) Date of Patent: Apr. 8, 2014

(54) ROTARY COMPRESSOR AND MANUFACTURING METHOD OF THE SAME

(75) Inventors: Hiroyuki Yoshida, Ota (JP); Takayasu Saito, Ota (JP); Yoshiaki Hiruma, Ota (JP); Takahiro Nishikawa, Oizumi-machi (JP); Masayuki Hara, Ota (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 1035 days.

(21) Appl. No.: 12/756,605

(22) Filed: Apr. 8, 2010

(65) Prior Publication Data

US 2011/0076173 A1 Mar. 31, 2011

(30) Foreign Application Priority Data

Sep. 29, 2009 (JP) ..... 2009-224241

(51) Int. Cl.
*F01C 1/30* (2006.01)
*F01C 1/02* (2006.01)
*B23P 15/00* (2006.01)

(52) U.S. Cl.
USPC ..... 418/11; 418/60; 418/270; 29/888.025

(58) Field of Classification Search
USPC ..... 418/11, 60, 270; 29/888.025
See application file for complete search history.

(56) References Cited

U.S. PATENT DOCUMENTS

| | | | | |
|---|---|---|---|---|
| 2,612,311 | A * | 9/1952 | Warrick et al. | 417/410.3 |
| 4,629,403 | A * | 12/1986 | Wood | 418/1 |
| 5,829,960 | A * | 11/1998 | Dreiman | 418/63 |
| 2006/0073061 | A1 * | 4/2006 | Sato | 418/149 |

FOREIGN PATENT DOCUMENTS

| | | | |
|---|---|---|---|
| JP | 2001280277 | A | 10/2001 |
| JP | 2007-56860 | A | 3/2007 |

* cited by examiner

*Primary Examiner* — Hoang Nguyen
(74) *Attorney, Agent, or Firm* — Westerman, Hattori, Daniels & Adrian, LLP

(57) ABSTRACT

There is disclosed a rotary compressor which delays a pressure rise on a high pressure chamber side in a cylinder of a rotary compression element to decrease a high pressure load applied to a roller and a rotary shaft, thereby improving performance. In the rotary compressor including a sealed container in which an electromotive element (a driving element) and first and second rotary compression elements driven by a rotary shaft of the electromotive element are included, each of the rotary compression elements being constituted of a cylinder, a roller fitted into an eccentric portion formed on the rotary shaft to eccentrically rotate in the cylinder, and a vane which abuts on the roller to partition the inside of the cylinder into a low pressure chamber side and a high pressure chamber side, the inner diameter of a suction passage formed in each cylinder is 59% or more and 70% or less of the thickness of the cylinder.

2 Claims, 5 Drawing Sheets

ROTARY COMPRESSOR AND MANUFACTURING METHOD OF THE SAME

BACKGROUND OF THE INVENTION

The present invention relates to a rotary compressor comprising a sealed container in which a driving element and a rotary compression element driven by the rotation of this driving element are provided, and a manufacturing method of the rotary compressor.

Heretofore, this type of rotary compressor has comprised a sealed container in which a driving element and a rotary compression element driven by a rotary shaft of this driving element are included. The rotary compression element is constituted of a cylinder, a roller fitted into an eccentric portion formed on the rotary shaft to eccentrically rotate in the cylinder, a vane which abuts on the roller to partition the inside of the cylinder into a low pressure chamber side and a high pressure chamber side, a support member which closes the open surface of the cylinder and which has a bearing of the rotary shaft, and a discharge muffler chamber provided opposite to the position of the cylinder of the support member. Moreover, the discharge muffler chamber is connected to the high pressure chamber side in the cylinder via a discharge port, and in the discharge muffler chamber, a discharge valve is provided which openably closes the discharge port.

Moreover, when the driving element is driven, a low-temperature low-pressure refrigerant gas is sucked into the low pressure chamber side of the cylinder through a suction passage, and compressed by the operation of the roller and the vane. When the refrigerant gas in the cylinder is compressed to reach a predetermined pressure by the operation of the roller and the vane, the discharge valve is pushed upwardly by such a pressure of the refrigerant gas to connect the high pressure chamber side of the cylinder to the discharge muffler chamber via the discharge port. In consequence, the refrigerant gas on the high pressure chamber side of the cylinder is discharged from the high pressure chamber side of the cylinder to the discharge muffler chamber through the discharge port. The high-temperature high-pressure refrigerant gas discharged to the discharge muffler chamber is discharged into the sealed container, and then discharged to the outside through the sealed container (e.g., see Japanese Patent Application Laid-Open No. 2007-56860 (Patent Document 1)).

In addition, when such a rotary compressor is mounted in an air conditioner, the improvement of a performance from a rated load operation to an intermediate load operation has become necessary owing to an energy saving regulation in recent years. FIG. 9 is a diagram showing the pressure transition in the rated load operation and the intermediate load operation at the rotation angles of a conventional rotary compressor. In FIG. 9, a broken line shows the pressure transition during the rated load operation in the conventional compressor, and a solid line shows the pressure transition during the intermediate load operation in the conventional compressor. As shown in FIG. 9, the intermediate load operation has operating conditions on which a condensation temperature is low as compared with the rated load operation. Therefore, in the conventional rotary compressor, the pressure in the cylinder rapidly reaches a high pressure during the intermediate load operation, and hence the discharge valve is opened in an early stage. Moreover, this opened discharge valve remains opened until the roller passes through the discharge port. In such a state where the discharge valve is opened, the pressure on the high pressure chamber side in the cylinder has the highest state, and a high pressure load is applied to the roller in the cylinder and the rotary shaft, whereby a problem occurs that the performance of the compressor is accordingly influenced.

SUMMARY OF THE INVENTION

The present invention has been developed to solve such a conventional technical problem, and an object thereof is to delay a pressure rise on a high pressure chamber side in a cylinder, thereby decreasing a high pressure load applied to a roller or a rotary shaft, whereby the performance of a compressor is improved.

That is, according to a first aspect of the present invention, there is provided a rotary compressor comprising a sealed container in which a driving element and a rotary compression element driven by a rotary shaft of the driving element are included, this rotary compression element being constituted of a cylinder, a roller fitted into an eccentric portion formed on the rotary shaft to eccentrically rotate in the cylinder, and a vane which abuts on this roller to partition the inside of the cylinder into a low pressure chamber side and a high pressure chamber side, characterized in that the inner diameter of a suction passage formed in the cylinder is 59% or more and 70% or less of the thickness of the cylinder.

According to a second aspect of the present invention, there is provided a rotary compressor comprising a sealed container in which a driving element and a rotary compression element driven by a rotary shaft of the driving element are included, this rotary compression element being constituted of a cylinder, a roller fitted into an eccentric portion formed on the rotary shaft to eccentrically rotate in the cylinder, and a vane which abuts on this roller to partition the inside of the cylinder into a low pressure chamber side and a high pressure chamber side, the rotary compressor further comprising a suction passage formed in the cylinder, characterized in that the cylinder is provided with a groove which extends from an outlet of the suction passage in the rotating direction of the rotary shaft.

The rotary compressor of a third aspect of the present invention is characterized in that in the second aspect of the present invention, the groove is formed within the thickness dimension of the roller.

A manufacturing method of a rotary compressor according to a fourth aspect of the present invention is characterized by comprising: including, in a sealed container, a driving element and a rotary compression element driven by a rotary shaft of this driving element; constituting this rotary compression element of a cylinder, a roller fitted into an eccentric portion formed on the rotary shaft to eccentrically rotate in the cylinder, and a vane which abuts on the roller to partition the inside of the cylinder into a low pressure chamber side and a high pressure chamber side; and enlarging the inner diameter of a suction passage formed in the cylinder to delay a pressure rise on the high pressure chamber side.

According to the first aspect of the present invention, in the sealed container, the driving element and the rotary compression element driven by the rotary shaft of the driving element are included. This rotary compression element is constituted of the cylinder, the roller fitted into the eccentric portion formed on the rotary shaft to eccentrically rotate in the cylinder, and the vane which abuts on this roller to partition the inside of the cylinder into the low pressure chamber side and the high pressure chamber side. In the rotary compressor, the inner diameter of the suction passage formed in the cylinder is 59% or more and 70% or less of the thickness of the cylinder. Therefore, the timing of a suction process of a low pressure refrigerant into the low pressure chamber side in the cylinder can be delayed. In consequence, the pressure rise on the high pressure chamber side can be delayed to shorten a time when the pressure on the high pressure chamber side in the cylinder becomes the highest pressure.

In particular, the inner diameter of the suction passage formed in the cylinder is 59% or more and 70% or less of the thickness of the cylinder, which can optimize a timing at which the pressure on the high pressure chamber side in the cylinder becomes the highest pressure. In consequence, a time to apply a high pressure load to the roller or the rotary shaft can be shortened to noticeably improve the performance of the compressor.

According to the second aspect of the present invention, in the sealed container, the driving element and the rotary compression element driven by the rotary shaft of the driving element are included. This rotary compression element is constituted of the cylinder, the roller fitted into the eccentric portion formed on the rotary shaft to eccentrically rotate in the cylinder, and the vane which abuts on this roller to partition the inside of the cylinder into the low pressure chamber side and the high pressure chamber side. The rotary compressor further comprises the suction passage formed in the cylinder, and the cylinder is provided with the groove which extends from the outlet of the suction passage in the rotating direction of the rotary shaft. This groove can delay the timing of the suction process of the low pressure refrigerant into the low pressure chamber side in the cylinder, thereby delaying the pressure rise on the high pressure chamber side.

This shortens the time when the pressure on the high pressure chamber side in the cylinder becomes the highest temperature; whereby the time to apply the high pressure load to the roller or the rotary shaft can be shortened to noticeably improve the performance of the compressor.

In particular, the groove is formed within the thickness dimension of the roller as in the third aspect of the present invention, whereby it is possible to prevent a disadvantage that the refrigerant gas in the cylinder leaks out of the groove.

According to the manufacturing method of the rotary compressor of the fourth aspect of the present invention, in the sealed container, the driving element and the rotary compression element driven by the rotary shaft of this driving element are included. This rotary compression element is constituted of the cylinder, the roller fitted into the eccentric portion formed on the rotary shaft to eccentrically rotate in the cylinder, and the vane which abuts on the roller to partition the inside of the cylinder into the low pressure chamber side and the high pressure chamber side. Moreover, the inner diameter of the suction passage formed in the cylinder can be enlarged to delay the pressure rise on the high pressure chamber side.

This shortens the time when the pressure on the high pressure chamber side in the cylinder becomes the highest pressure, whereby the time to apply this high pressure load to the roller or the rotary shaft can be shortened to noticeably improve the performance of the compressor.

DETAILED DESCRIPTION OF THE PREFERRED EMBODIMENTS

Hereinafter, embodiments of the present invention will be described in detail with reference to the drawings.

Embodiment 1

Figure 1:
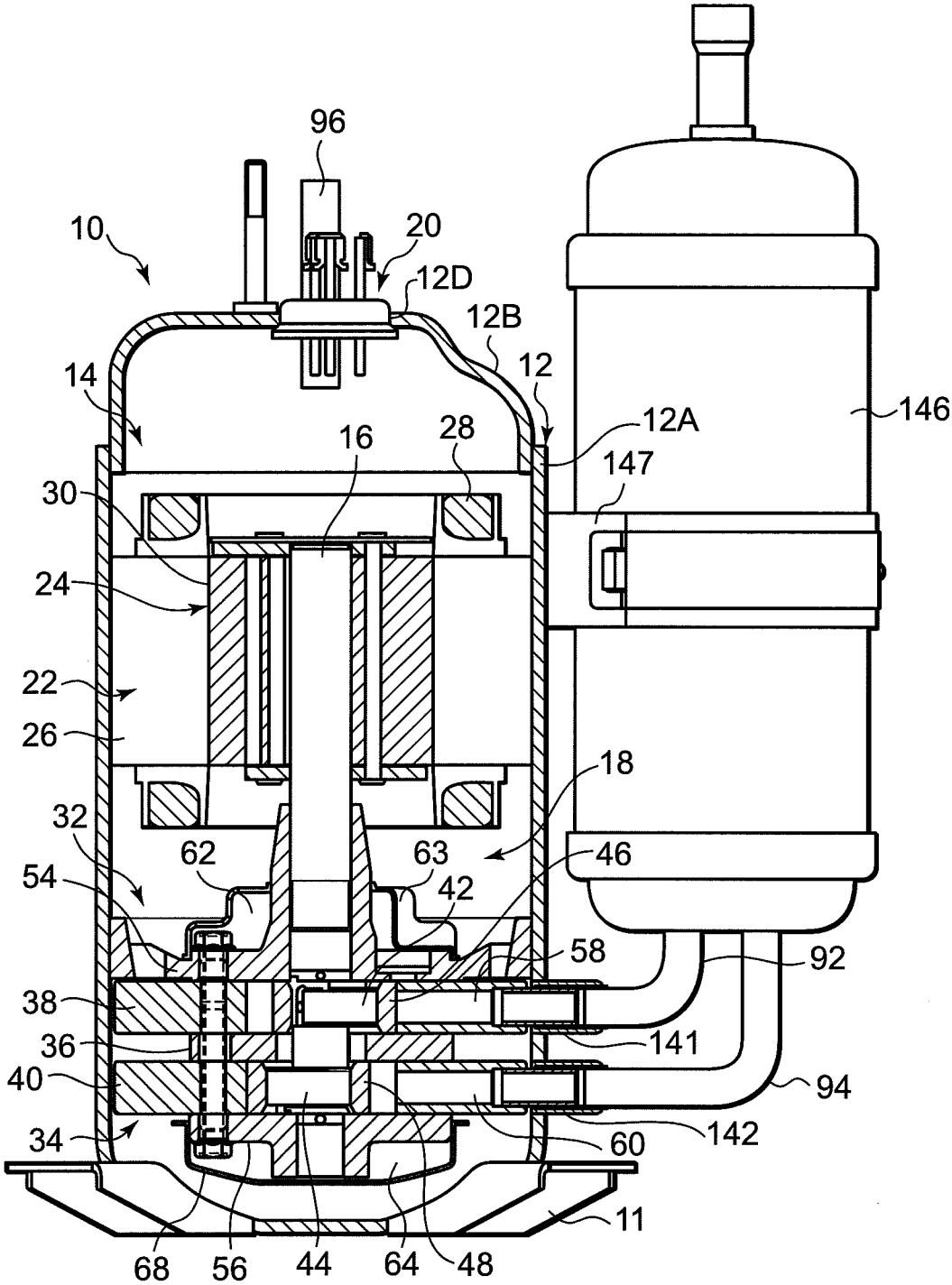
FIG. 1 is a vertically sectional side view of a rotary compressor according to one embodiment to which the present invention is applied.
Figure 2:
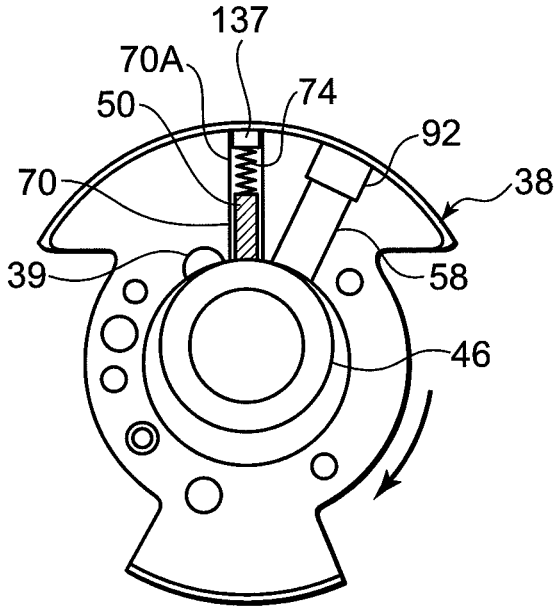
FIG. 2 is a sectional plan view of a first cylinder of the rotary compressor of FIG. 1.
Figure 3:
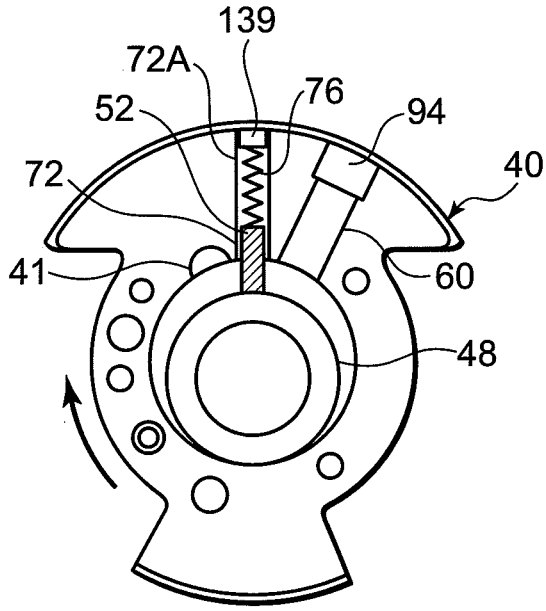
FIG. 3 is a sectional plan view of a second cylinder of the rotary compressor of FIG. 1.

FIG. 1 shows a vertically sectional side view of a rotary compressor according to one embodiment to which the present invention is applied, FIG. 2 shows a sectional plan view of a first cylinder 38 shown in FIG. 1, and FIG. 3 shows a sectional plan view of a second cylinder 40, respectively. A rotary compressor 10 of the present embodiment is an internal high pressure type rotary compressor (a multicylinder rotary compressor) comprising first and second rotary compression elements. It is to be noted that in the rotary compressor 10 of the present embodiment is mounted in an air conditioner, and the rotary compressor 10 constitutes a refrigerant circuit of the air conditioner together with an outdoor side heat exchanger, an indoor side heat exchanger and an expansion valve as pressure reduction means (not shown).

The rotary compressor 10 of the present embodiment comprises a vertically cylindrical sealed container 12 made of a steel plate which includes an electromotive element 14 as a driving element disposed on the upside of an internal space of the sealed container 12, and a rotary compression mechanism part 18 disposed under the electromotive element 14 and constituted of first and second rotary compression elements 32 and 34 driven by a rotary shaft 16 of the electromotive element 14.

The bottom part of the sealed container 12 is an oil reservoir, and the sealed container is constituted of a container main body 12A in which the electromotive element 14 and the rotary compression mechanism part 18 are included, and a substantially bowl-like end cap (a lid member) 12B which closes an upper opening of the container main body 12A. Moreover, the upper surface of the end cap 12B is provided with a round attachment hole 12D, and a terminal (a wiring line is omitted) 20 for supplying a power to the electromotive element 14 is attached to the attachment hole 12D.

Moreover, a refrigerant discharge tube 96 described later is attached to the end cap 12B, and one end of the refrigerant discharge tube 96 is connected to the inside of the sealed container 12. Moreover, a base 11 for attachment is provided in the bottom part of the sealed container 12.

The electromotive element 14 is constituted of a stator 22 welded and fixed in a ring shape along the inner peripheral surface of the upper space of the sealed container 12, and a rotor 24 inserted and installed on the inner side of the stator 22 with a slight space being left from the stator, and the rotor 24 is fixed to the rotary shaft 16 passing the center thereof and extending in a vertical direction.

The stator 22 has a laminate 26 in which donut-like electromagnetic steel plates are laminated, and a stator coil 28 wound around tooth portions of the laminate 26 by a direct winding (concentrated winding) system. Moreover, the rotor 24 is also a laminate 30 of electromagnetic steel plates in the same manner as in the stator 22.

Between the first rotary compression element 32 and the second rotary compression element 34, an intermediate partition plate 36 is sandwiched. That is, the first rotary compression element 32 and the second rotary compression element 34 are constituted of the intermediate partition plate 36; the first and second cylinders 38 and 40 disposed on and under the intermediate partition plate 36; first and second rollers 46 and 48 fitted into upper and lower eccentric portions 42 and 44 formed on the rotary shaft 16 with a phase difference of 180 degrees in the first and second cylinders 38 and 40, to eccentrically rotate in the cylinders 38 and 40, respectively; first and second vanes 50 and 52 which abut on the first and second rollers 46 and 48 to partition the insides of the cylinders 38 and 40 into a low pressure chamber side and a high pressure chamber side, respectively; and an upper support member 54 and a lower support member 56 as the support members which close the upper open surface of the first cylinder 38 and the lower open surface of the second cylinder 40 and which are also used as bearings of the rotary shaft 16.

In the first and second cylinders 38 and 40, there are formed suction passages 58 and 60 connected to the low pressure chamber side in the first and second cylinders 38 and 40, respectively, and the suction passages 58 and 60 are connected to refrigerant introduction tubes 92 and 94 described later, respectively.

Moreover, a discharge muffler chamber 62 is provided on the upside of the upper support member 54, and a refrigerant gas compressed by the first rotary compression element 32 is discharged to the discharge muffler chamber 62 through a discharge port 39. The discharge muffler chamber 62 has, in its center, a hole through which the rotary shaft 16 and the upper support member 54 also used as the bearing of the rotary shaft 16 extend, and is formed in a substantially bowl-like cup member 63 which covers the electromotive element 14 side (the upside) of the upper support member 54. Moreover, above the cup member 63, the electromotive element 14 is disposed with a predetermined space being left from the cup member 63.

A discharge muffler chamber 64 is provided under the lower support member 56, and the refrigerant gas compressed by the second rotary compression element 34 is discharged to the discharge muffler chamber 64 through a discharge port 41. The discharge muffler chamber 64 has, in its center, a hole through which the rotary shaft 16 and the lower support member 56 also used as the bearing of the rotary shaft 16 extend, and is formed in a substantially bowl-like cup member 68 which covers the lower support member 56 opposite to the electromotive element 14 (the downside).

Figure 4:
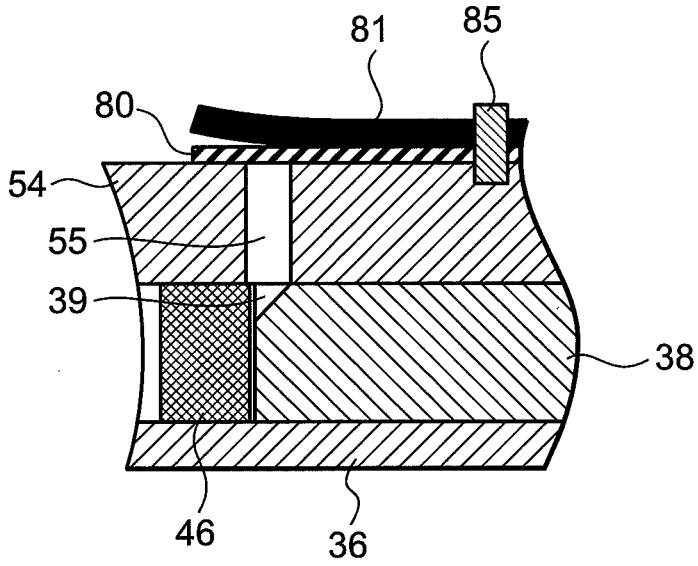
FIG. 4 is a partially enlarged vertically sectional side view of the first cylinder of FIG. 2 around a discharge port.

In the upper support member 54 which is the lower surface of the discharge muffler chamber 62, as shown in FIG. 4, a discharge hole 55 is formed at a position corresponding to the discharge port 39 formed in the cylinder 38, and a discharge valve 80 which openably closes the discharge hole 55 is attached to a position corresponding to the upper end opening of the discharge hole 55. The discharge valve 80 is an elastic member made of a substantially vertically rectangular metal plate, one end of the discharge valve 80 abuts on the discharge hole 55 to hermetically close the hole, and the other side of the discharge valve is secured to an attachment hole formed in the upper support member 54 by a caulking pin 85 with a predetermined gap being left from the discharge hole 55.

A backer valve 81 as a discharge valve presser plate is disposed on the upside of the discharge valve 80, and is attached to the upper support member 54 by the caulking pin 85 in the same manner as in the discharge valve 80.

Moreover, the high pressure chamber side refrigerant gas compressed in the cylinder 38 to reach a predetermined pressure pushes upwardly the discharge valve 80 which closes the discharge hole 55, to open the upper end opening of the discharge hole 55. In consequence, the high pressure chamber side in the cylinder 38 is connected to the discharge muffler chamber 62 via the discharge port 39 and the discharge hole 55, and the high-temperature high-pressure refrigerant gas in the cylinder 38 is discharged into the discharge muffler chamber 62. At this time, since the other side of the discharge valve 80 is secured to the upper support member 54, the one side thereof which abuts on the discharge hole 55 warps, bends and abuts on the backer valve 81 which regulates the open amount of the discharge valve 80. Furthermore, when the discharge of the refrigerant gas ends, the discharge valve 80 is detached from the backer valve to close the discharge hole 55.

Figure 5:
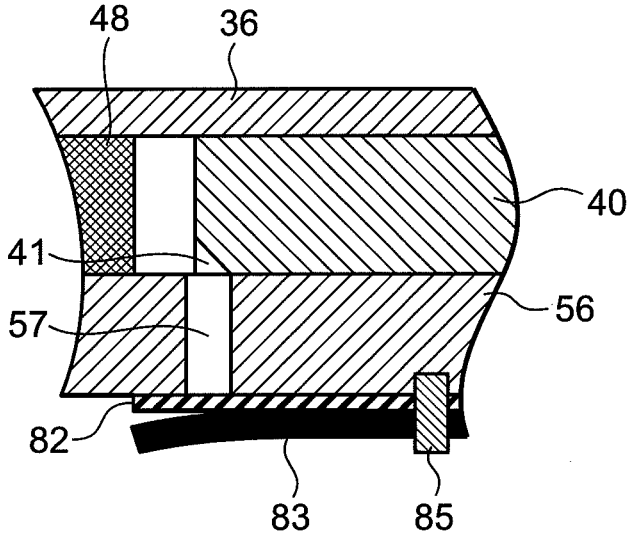
FIG. 5 is a partially enlarged vertically sectional side view of the second cylinder of FIG. 3 around a discharge port.

Similarly, in the lower support member 56 which is the upper surface of the discharge muffler chamber 64, as shown in FIG. 5, a discharge hole 57 is formed at a position corresponding to the discharge port 41 formed in the cylinder 40, and a discharge valve 82 which openably closes the discharge hole 57 is attached to a position corresponding to the lower end opening of the discharge hole 57. The discharge valve 82 is also an elastic member made of a substantially vertically rectangular metal plate in the same manner as in the discharge valve 80. One end of the discharge valve 82 abuts on the discharge hole 57 to hermetically close the hole, and the other side of the discharge valve is secured to an attachment hole formed in the lower support member 56 by a caulking pin 85 with a predetermined gap being left from the discharge hole 57.

A backer valve 83 as a discharge valve presser plate is disposed on the downside of the discharge valve 82, and is attached to the lower support member 56 by the caulking pin 85 in the same manner as in the discharge valve 82.

Moreover, the high pressure chamber side refrigerant gas compressed in the cylinder 40 to reach a predetermined pressure pushes upwardly the discharge valve 82 which closes the discharge hole 57, to open the lower end opening of the discharge hole 57. In consequence, the high pressure chamber side in the cylinder 40 is connected to the discharge muffler chamber 64 via the discharge port 41 and the discharge hole 57, and the high-temperature high-pressure refrigerant gas in the cylinder 40 is discharged into the discharge muffler chamber 64. At this time, since the other side of the discharge valve 82 is secured to the lower support member 56, the one side thereof which abuts on the discharge hole 57 warps, bends and abuts on the backer valve 83 which regulates the open amount of the discharge valve. When the discharge of the refrigerant gas ends, the discharge valve 82 is detached from the backer valve 83 to close the discharge hole 57.

Furthermore, as shown in FIG. 2, the first cylinder 38 is provided with a guide groove 70 in which the first vane 50 is included, and the outside of the guide groove 70, that is, the back surface side of the first vane 50 is provided with a storage portion 70A in which a spring 74 as a spring member is included. The spring 74 abuts on the end of the first vane 50 on the back surface side thereof to constantly urge the first vane 50 toward the first roller 46. Moreover, the storage portion 70A opens on the side of the guide groove 70 and the sealed container 12 (the container main body 12A), and a metal plug 137 is provided on the sealed container 12 side of the spring 74 included in the storage portion 70A, and functions as a stopper for the spring 74. It is to be noted that FIG. 2 shows a sectional plan view of the first cylinder 38 in a case where the first roller 46 is positioned at a top dead center where the first vane 50 is not exposed most in the first cylinder 38. Moreover, in FIG. 2, a bold arrow indicates the rotating direction of the roller 46.

On the other hand, as shown in FIG. 3, the second cylinder 40 is provided with a guide groove 72 in which the second vane 52 is included, and the outside of the guide groove 72, that is, the back surface side of the second vane 52 is provided with a storage portion 72A in which a spring 76 as a spring member is included. The spring 76 abuts on the end of the second vane 52 on the back surface side thereof to constantly urge the second vane 52 toward the second roller 48. Moreover, the storage portion 72A opens on the side of the guide groove 72 and the sealed container 12 (the container main body 12A), and a metal plug 139 is provided on the sealed container 12 side of the spring 76 included in the storage portion 72A, and functions as a stopper for the spring 76. It is to be noted that FIG. 3 shows a sectional plan view of the second cylinder 40 in a case where the second roller 48 is positioned at a bottom dead center where the second vane 52 is exposed most in the second cylinder 40. Moreover, in FIG. 3, a bold arrow indicates the rotating direction of the roller 48.

On the other hand, on the side surface of the container main body 12A of the sealed container 12, sleeves 141 and 142 are welded and fixed to positions corresponding to the suction passages 58 and 60 of the first cylinder 38 and the second cylinder 40, respectively. The sleeve 141 is disposed vertically adjacent to the sleeve 142.

Moreover, one end of the refrigerant introduction tube 92 for introducing the refrigerant gas into the first cylinder 38 is inserted and connected to the sleeve 141, and the one end of the refrigerant introduction tube 92 is connected to the suction passage 58 of the upper cylinder 38. The other end of the refrigerant introduction tube 92 opens in an accumulator 146.

One end of the refrigerant introduction tube 94 for introducing the refrigerant gas into the second cylinder 40 is inserted and connected to the sleeve 142, and the one end of the refrigerant introduction tube 94 is connected to the suction passage 60 of the second cylinder 40. The other end of the refrigerant introduction tube 94 opens in the accumulator 146 in the same manner as in the refrigerant introduction tube 92.

The accumulator 146 is a tank which performs gas-liquid separation of the sucked refrigerant, and is attached to the side surface of the upper part of the container main body 12A of the sealed container 12 via a bracket 147. Moreover, the refrigerant introduction tubes 92 and 94 are inserted into the bottom part of the accumulator 146, and the opening of the other end of each tube is positioned on the upside in the accumulator 146.

It is to be noted that the discharge muffler chamber 64 is connected to the discharge muffler chamber 62 via a communication path (not shown) which extends through the upper and lower support members 54 and 56, the first and second cylinders 38 and 40 and the intermediate partition plate 36 in an axial center direction (a vertical direction). Moreover, the high-temperature high-pressure refrigerant gas compressed by the second rotary compression element 34 and discharged to the discharge muffler chamber 64 is discharged to the discharge muffler chamber 62 through the communication path to join the high-temperature high-pressure refrigerant gas compressed by the first rotary compression element 32.

Moreover, the discharge muffler chamber 62 is connected to the sealed container 12 via a hole (not shown) formed so as to extend through the cup member 63, and through this hole, the high pressure refrigerant gas compressed by the first and second rotary compression elements 32 and 34 is discharged into the sealed container 12.

Next, the operation of the rotary compressor 10 having the above constitution will be described. When the stator coil 28 of the electromotive element 14 is energized through the terminal 20 and a wiring line (not shown), the electromotive element 14 starts to rotate the rotor 24. By this rotation, the first and second rollers 46 and 48 fitted into the upper and lower eccentric portions 42 and 44 integrally provided on the rotary shaft 16 eccentrically rotate in the first and second cylinders 38 and 40.

In consequence, the only gas refrigerant (the refrigerant gas) separated from a liquid in the accumulator 146 enters the refrigerant discharge tubes 92 and 94 which open in the accumulator 146. The low pressure refrigerant gas which has entered the refrigerant introduction tube 92 is sucked into the low pressure chamber side of the first cylinder 38 of the first rotary compression element 32 through the suction passage 58.

The refrigerant gas sucked into the low pressure chamber side of the first cylinder 38 is compressed by the operation of the first roller 46 and the first vane 50. Subsequently, when the refrigerant gas in the first cylinder 38 reaches a predetermined high pressure, the discharge valve 80 is pushed upwardly by the high pressure of the refrigerant gas to open the upper end opening of the discharge hole 55, thereby connecting the high pressure chamber side of the cylinder 38 to the discharge muffler chamber 62 via the discharge port 39 and the discharge hole 55. In consequence, the refrigerant gas on the high pressure chamber side in the cylinder 38 is discharged to the discharge muffler chamber 62 through the discharge port 39 and the discharge hole 55.

On the other hand, the low pressure refrigerant gas which has entered the refrigerant introduction tube 94 is sucked into the low pressure chamber side of the second cylinder 40 of the second rotary compression element 34 through the suction passage 60. The refrigerant gas sucked into the low pressure chamber side of the second cylinder 40 is compressed by the operation of the second roller 48 and the second vane 52. Subsequently, when the refrigerant gas in the second cylinder 40 reaches a predetermined high pressure, the discharge valve 82 is pushed by the high pressure of the refrigerant gas to open the lower end opening of the discharge hole 57, thereby connecting the high pressure chamber side of the cylinder 40 to the discharge muffler chamber 64 via the discharge port 41 and the discharge hole 57. In consequence, the refrigerant gas on the high pressure chamber side in the cylinder 40 is discharged to the discharge muffler chamber 64 through the discharge port 41 and the discharge hole 57.

Then, the refrigerant gas discharged to the discharge muffler chamber 64 is discharged to the discharge muffler chamber 62 through the communication path to join the refrigerant compressed by the first rotary compression element 32. The joined refrigerant gas is discharged into the sealed container 12 through the hole (not shown) formed so as to extend through the cup member 63.

Afterward, the high-temperature high-pressure refrigerant gas discharged into the sealed container 12 passes through the gap of the electromotive element 14 to move upwardly in the sealed container 12, and is discharged to the outside through the refrigerant discharge tube 96 formed in the end cap 12B.

It is to be noted that as to the discharge valves 80 and 82, when the discharge of the refrigerant gas ends, that is, when the rollers 46 and 48 finish passing through the discharge ports 39 and 41 to lower the pressure in the cylinders 38 and 40, the discharge valves 80 and 82 are detached from the backer valves 81 and 83 to close the discharge holes 55 and 57. In this way, by the rotating operation of the rollers 46 and 48, a suction (suck-in) process of sucking the low-temperature low-pressure refrigerant gas through the suction passages 58 and 60, a compression process of compressing the sucked refrigerant and a discharge process of discharging the compressed high-temperature high-pressure refrigerant gas are repeated.

Additionally, such a rotary compressor has heretofore had a constitution in which when a rotation angle at which the rollers 46 and 48 are positioned at the top dead center is 0° during a usual operation (i.e., an intermediate operation region with a usual load), the rollers 46 and 48 rotate as much as about 180° to 190° from the top dead center in the (clockwise) direction shown by the bold arrows in FIGS. 2 and 3, and the high pressure chamber side refrigerant gases of the cylinders 38 and 40 reach the predetermined high pressure to open the discharge valves 80 and 82.

Subsequently, the high pressure chamber side pressure in the cylinders 38 and 40 keeps the highest pressure state until the rollers 46 and 48 finish passing through the discharge ports 39 and 41 after opening the discharge valves 80 and 82. Therefore, when the high pressure chamber side pressure in the cylinders 38 and 40 rapidly rises to open the discharge valves 80 and 82, this lengthens a time when the high pressure chamber side pressure in the cylinders 38 and 40 becomes highest. In consequence, the highest pressure is applied to the insides of the cylinders 38 and 40, and the rollers 46 and 48, the rotary shaft 16 and the vanes 50 and 52 are influenced by the application of such a high pressure. In consequence, a problem occurs that performance is adversely affected by the application of the high pressure.

To solve the problem, in the present invention, the inner diameters of the suction passages 58 and 60 of the cylinders 38 and 40 are enlarged as compared with the conventional example, whereby the pressure rise on the high pressure chamber side is delayed to shorten the time when the high pressure chamber side pressure becomes highest.

In the present embodiment, the suction passages 58 and 60 are formed by enlarging the inner diameters of the conventional suction passages 58 and 60 so as to set the inner diameters thereof in a range of 59% or more and 70% or less of the thicknesses of the cylinders 38 and 40. Specifically, in the present embodiment, the suction passages 58 and 60 are formed so that the thickness of each of the cylinders 38 and 40 is 16 mm, whereas the inner diameter of each suction passage is from 9.5 mm to 11.2 mm.

Figure 6:
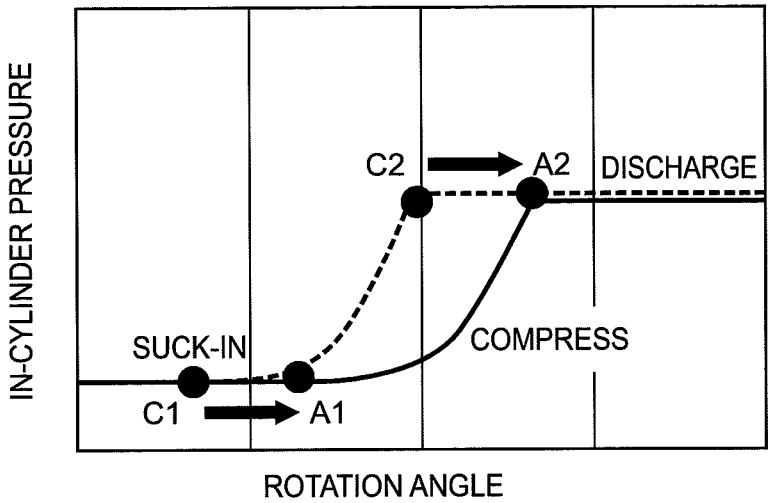
FIG. 6 is a diagram showing the transition of a pressure in the cylinder.
Figure 9:
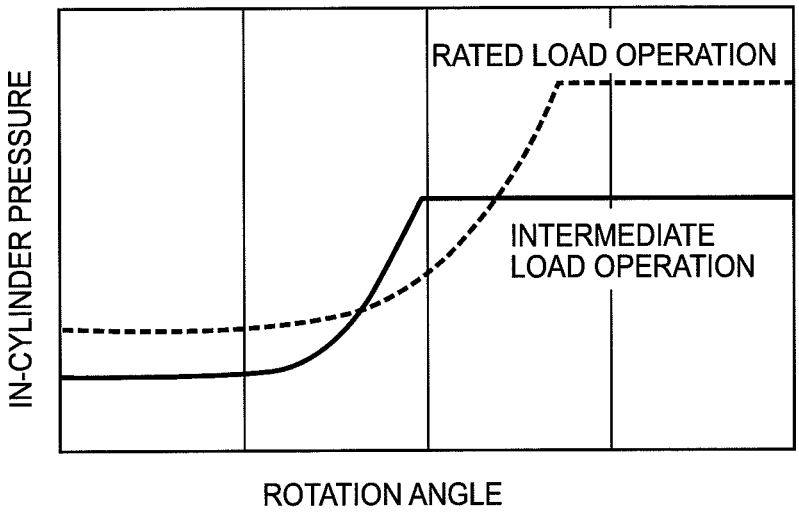
FIG. 9 PRIOR ART
FIG. 9 is a diagram showing the transition of a pressure during a rated load operation and an intermediate load operation at rotation angles of a conventional compressor.

FIG. 6 is a diagram showing pressure transition in the cylinders of the compressor including the conventional suction passages and the rotary compressor 10 of the present embodiment at rotation angles. In the conventional compressor, each cylinder has a thickness of 16 mm, whereas the inner diameter of each suction passage is set to 8.5 mm. That is, in the conventional compressor, the suction passage is formed so that the inner diameter thereof is about 53% of the thickness of the cylinder. In FIG. 6, a broken line shows the pressure transition in the cylinder of the conventional compressor at the rotation angles, C1 on this broken line indicates the end of the suction (suck-in) process of the low pressure refrigerant, and C2 shows the beginning of the discharge process, that is, the opening of the discharge valves. In this case, a curve between C1 and C2 indicates a compression process. Moreover, a solid line shows the pressure transition in the cylinders of the rotary compressor 10 of the present embodiment at the respective rotation angles, A1 on this solid line indicates the end of the suction (suck-in) process of the low pressure refrigerant, and A2 shows the beginning of the discharge process, that is, the opening of the discharge valves 80 and 82. In this case, a curve between A1 and A2 indicates a compression process.

As shown in FIG. 6, it is seen that in the conventional compressor, the suction process of the low pressure refrigerant ends around a rotation angle of 40°, and the process then shifts to the compression process in which the high pressure chamber side pressure reaches the highest pressure at a rotation angle of about 180°, thereby advancing to the discharge process. On the other hand, in a case where the suction passages 58 and 60 are formed so that the inner diameters thereof are set to a range of 59% or more and 70% or less of the thickness of each of the cylinders 38 and 40 as in the present invention, the suction process ends around 100°, and the process then shifts to the compression process in which the high pressure chamber side pressure reaches the highest pressure at a rotation angle of about 210°, thereby advancing to the discharge process.

In this case, when the inner diameter of each of the suction passages 58 and 60 is smaller than 59% of the thickness of each of the cylinders 38 and 40, inputs increase as much as +2%, for example, on operating conditions that a refrigerant temperature in the indoor side heat exchanger is +35° C. and that a refrigerant temperature in the outdoor side heat exchanger is +1.8° C. during an intermediate load operation in a warming operation, as compared with a case where the inner diameter is 59% or more of the thickness of each of the cylinders 38 and 40. In consequence, the coefficient of performance (COP) lowers as much as 1.7%. On the other hand, when the inner diameter of each of the suction passages 58 and 60 is smaller than 59% of the thickness of each of the cylinders 38 and 40, inputs increase as much as +1.3%, for example, on operating conditions that a refrigerant temperature in the outdoor side heat exchanger is +41.7° C. and that a refrigerant temperature in the indoor side heat exchanger is +16.8° C. during the intermediate load operation also in a cooling operation, as compared with a case where the inner diameter is 59% or more of the thickness of each of the cylinders 38 and 40. In consequence, the COP lowers as much as 1.8%. As described above, the inner diameter of each of the suction passages 58 and 60 is preferably 59% or more of the thickness of each of the cylinders 38 and 40.

On the other hand, when the inner diameter of each of the suction passages 58 and 60 is larger than 70% of the thickness of each of the cylinders 38 and 40, the diameters of the suction passages 58 and 60 are excessively large, and hence a seal member for acquiring air tightness in the cylinders 38 and 40 and the sealed container 12 and a further seal member for sealing among the refrigerant introduction tubes 92 and 94 connected to the accumulator 146 and the suction passages 58 and 60 cannot be attached. Therefore, the inner diameter of each of the suction passages 58 and 60 is preferably 70% or less of the thickness of each of the cylinders 38 and 40.

In this way, the inner diameters of the suction passages are enlarged as compared with the conventional suction passages, and are set to a range of 59% or more and 70% or less of the thicknesses of the cylinders 38 and 40, whereby the high pressure chamber side pressure reaches the highest pressure at a rotation angle of about 210°, and the process shifts to the discharge process. In particular, when the rotation angle of each of the rollers 46 and 48 is 210°, the discharge valves 80 and 82 open, thereby starting the discharge process. In consequence, it is possible to acquire a sufficient time for discharging the high-temperature high-pressure refrigerant gas on the high pressure chamber side to the discharge muffler chambers 62 and 64 through the discharge ports 39 and 41 and the discharge holes 55 and 57. Therefore, according to the present invention, it is possible to optimize the timing at which the high pressure chamber side pressure in the cylinders 38 and 40 becomes the highest pressure.

Consequently, it is possible to shorten the time when the high pressure load is applied to the rollers 46 and 48 and the rotary shaft 16, and the performance of the rotary compressor 10 can noticeably be improved.

Embodiment 2

Figure 7:
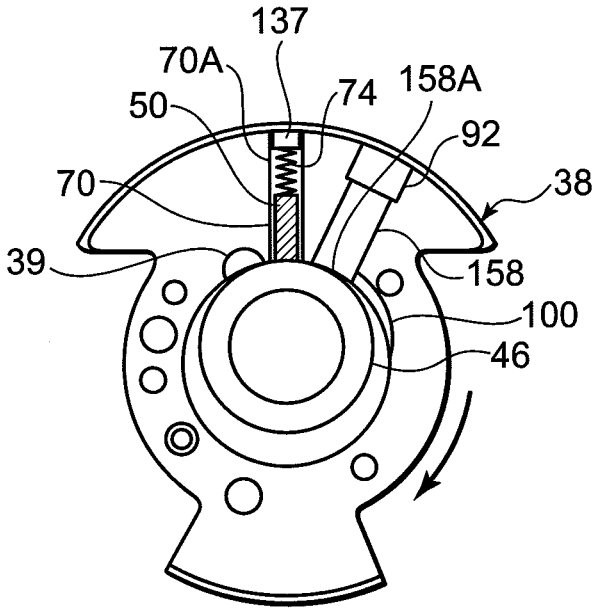
FIG. 7 is a sectional plan view of a first cylinder of another embodiment of the present invention (Embodiment 2)
Figure 8:
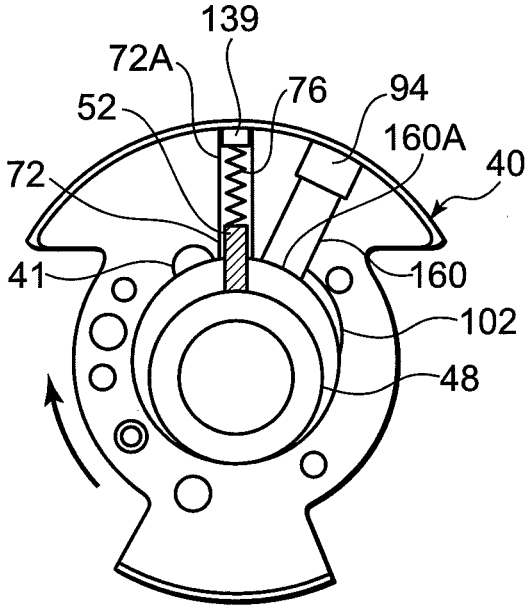
FIG. 8 is a sectional plan view of a second cylinder of the embodiment of the present invention.

Next, another embodiment of the present invention will be described with reference to FIGS. 7 and 8. FIG. 7 shows a sectional plan view of a first cylinder 38 of the present embodiment, and FIG. 8 shows a sectional plan view of a second cylinder 40, respectively. It is to be noted that in FIGS. 7 and 8, components denoted with the same reference numerals as those of FIGS. 1 to 5 have the same or similar effect, and hence the description thereof is omitted here.

In FIGS. 7 and 8, reference numerals 158 and 160 are conventional suction passages. That is, unlike suction passages of Embodiment 1 described above, the inner diameters of the suction passages 158 and 160 of the present embodiment are not enlarged, and the suction passages 158 and 160 are formed so that the inner diameter of each of the suction passages 158 and 160 is 8.5 mm, and is about 53% of the thickness (16 mm) of each of the cylinders 38 and 40.

In the present embodiment, as shown in FIGS. 7 and 8, grooves 100 and 102 extending in the cylinders 38 and 40 are formed in a predetermined angle range from outlets 158A and 160A of the suction passages 158 and 160 of the cylinders 38 and 40 in the rotating direction of rollers 46 and 48 (i.e., the rotating direction of a rotary shaft 16). The grooves 100 and 102 are formed, whereby the rotation angle at the start of the compression process of a refrigerant gas in the cylinders 38 and 40 can be delayed to the ends of the grooves 100 and 102 in the rotating direction of the rollers 46 and 48. That is, owing to the angle of each of the grooves 100 and 102 of the cylinders 38 and 40, the start of the compression of a refrigerant in the cylinders 38 and 40 can be delayed.

Therefore, in the present embodiment, the grooves 100 and 102 are formed in the rotating direction of the rollers 46 and 48 from the suction passages 158 and 160 so that the rotation angle at the start of the discharge process during a usual operation is about 210° as in Embodiment 1 described above (i.e., so that discharge valves 80 and 82 open at the rotation angle of about 210°). Especially in the present embodiment, the grooves 100 and 102 are formed within the thickness dimensions of the rollers 46 and 48.

The grooves 100 and 102 are formed as in the present embodiment, whereby the timing of the suction process of a low pressure refrigerant into a low pressure chamber side in the cylinders 38 and 40 can be delayed, thereby delaying a pressure rise on a high pressure chamber side.

In consequence, a time when the pressure on the high pressure chamber side in the cylinders becomes the highest pressure shortens, whereby a time when a high pressure load is applied to the rollers and the rotary shaft can be shortened to noticeably improve the performance of the compressor. Furthermore, the grooves 100 and 102 are formed so that the discharge valves 80 and 82 open at the rotation angle of 210° of the rollers 46 and 48 to start the discharge process as in the above embodiment, whereby it is possible to acquire a sufficient time for discharging a high-temperature high-pressure refrigerant gas on the high pressure chamber side to discharge muffler chambers 62 and 64 through discharge ports 39 and 41 and discharge holes 55 and 57. Therefore, according to the present invention, it is possible to optimize a timing at which the pressure on the high pressure chamber side in the cylinders 38 and 40 becomes the highest pressure.

Especially in the present embodiment, the grooves 100 and 102 are formed within the thickness dimensions of the rollers 46 and 48, whereby the grooves 100 and 102 can securely be closed with the side surfaces of the rollers 46 and 48, and hence it is possible to prevent a disadvantage that the refrigerant gas in the cylinders 38 and 40 leaks out of the grooves 100 and 102 to the outside of the cylinders 38 and 40.

It is to be noted that in the above embodiments, the present invention has been described by use of an internal high pressure type rotary compressor (a multicylinder rotary compressor) comprising first and second rotary compression elements, but the present invention is not limited to the embodiments, and can be applied to any rotary compressor as long as a driving element and a rotary compression element driven by a rotary shaft of the driving element are included in a sealed container.

What is claimed is:

1. A rotary compressor comprising a sealed container which comprises a driving element and a rotary compression element driven by a rotary shaft of the driving element, wherein the rotary compression element comprises a cylinder, a roller fitted into an eccentric portion formed on the rotary shaft to eccentrically rotate in the cylinder, and a vane which abuts on this roller to partition the inside of the cylinder into a low pressure chamber side and a high pressure chamber side, and wherein the inner diameter of a suction passage formed in the cylinder is 59% or more and 70% or less of the thickness of the cylinder.

2. A manufacturing method of a rotary compressor comprising:

including, in a sealed container, a driving element and a rotary compression element driven by a rotary shaft of this driving element;

constituting the rotary compression element constituted of a cylinder, a roller fitted into an eccentric portion formed on the rotary shaft to eccentrically rotate in the cylinder, and a vane which abuts on the roller to partition the inside of the cylinder into a low pressure chamber side and a high pressure chamber side; and enlarging the inner diameter of a suction passage formed in the cylinder to delay a pressure rise on the high pressure chamber side, wherein the inner diameter of the suction passage is between 59% to 70% of a thickness of the cylinder.

* * * * *